US008424606B2

(12) United States Patent
Zhan et al.

(10) Patent No.: US 8,424,606 B2
(45) Date of Patent: Apr. 23, 2013

(54) METHOD AND APPARATUS FOR PERFORATING WITH REDUCED DEBRIS IN WELLBORE

(75) Inventors: Lang Zhan, Pearland, TX (US); Jean-Luc Lafontan, Kuala Lumpur (MY); Harvey Williams, Houston, TX (US); Jeremy P. Harvey, Houston, TX (US); Brenden Grove, Missouri City, TX (US); Lawrence A. Behrmann, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 196 days.

(21) Appl. No.: 12/492,310

(22) Filed: Jun. 26, 2009

(65) Prior Publication Data

US 2010/0163238 A1 Jul. 1, 2010

Related U.S. Application Data

(60) Provisional application No. 61/140,937, filed on Dec. 27, 2008.

(51) Int. Cl.
*E21B 29/00* (2006.01)

(52) U.S. Cl.
USPC ..... 166/297; 166/299; 166/55

(58) Field of Classification Search ..... 166/299, 166/55, 305.1, 306, 311, 99, 171, 177.5, 166/297, 298; 175/2–4.6
See application file for complete search history.

(56) References Cited

U.S. PATENT DOCUMENTS

| | | | | | |
|---|---|---|---|---|---|
| 3,347,314 | A | * | 10/1967 | Schuster | 166/286 |
| 3,630,282 | A | * | 12/1971 | Lanmon, II | 166/297 |
| 3,707,195 | A | * | 12/1972 | Lanmon, II | 175/4.52 |
| 3,727,692 | A | * | 4/1973 | Kinley et al. | 166/297 |
| 4,105,070 | A | * | 8/1978 | Lavigne et al. | 166/250.13 |
| 4,105,073 | A | * | 8/1978 | Brieger | 166/286 |
| 4,515,217 | A | * | 5/1985 | Stout | 166/297 |

(Continued)

FOREIGN PATENT DOCUMENTS

| | | | |
|---|---|---|---|
| GB | 2396175 | A | 6/2004 |
| GB | 2403968 | A | 1/2005 |

(Continued)

OTHER PUBLICATIONS

Walton, I.C., Atwood, D.C., Halleck, P.M. and Bianco, L.C.B.: "Perforating unconsolidated sands: an experimental and theoretical investigation," SPEDC, p. 141-149, Sep. 2002.

*Primary Examiner* — Shane Bomar
*Assistant Examiner* — Kipp Wallace

(57) ABSTRACT

A perforating system having a perforating gun with a tubular gun housing defining an inner volume and extending in an axial direction. A shaped charge is held in a loading tube. The loading tube is located in the gun housing. The loading tube extends along the axial direction. The shaped charge faces in a firing direction substantially perpendicular to the axial direction. A portion of the gun housing adjacent to the shaped charge in the firing direction is a perforating portion for removal upon firing of the shaped charge. An eccentralizer member extends from the perforating gun in a second direction that is substantially opposite and parallel with the firing direction. A first retainer part extends from an outer surface of the gun housing adjacent to the perforating portion. A second retainer part extends from the outside of the gun housing adjacent to the perforating portion.

12 Claims, 4 Drawing Sheets

U.S. PATENT DOCUMENTS

| | | | | |
|---|---|---|---|---|
| 4,756,371 | A * | 7/1988 | Brieger | 166/312 |
| 5,379,845 | A * | 1/1995 | Blount et al. | 166/382 |
| 6,220,370 | B1 * | 4/2001 | Wesson et al. | 175/4.52 |
| 6,554,081 | B1 | 4/2003 | Brooks et al. | |
| 6,575,247 | B2 * | 6/2003 | Tolman et al. | 166/305.1 |
| 6,598,682 | B2 | 7/2003 | Johnson et al. | |
| 6,672,405 | B2 * | 1/2004 | Tolman et al. | 175/4.52 |
| 6,732,798 | B2 | 5/2004 | Johnson et al. | |
| 6,874,579 | B2 | 4/2005 | Johnson et al. | |
| 6,966,377 | B2 | 11/2005 | Johnson et al. | |
| 7,036,594 | B2 | 5/2006 | Walton et al. | |
| 7,121,340 | B2 | 10/2006 | Grove et al. | |
| 7,182,138 | B2 | 2/2007 | Behrmann et al. | |
| 7,195,066 | B2 | 3/2007 | Sukup et al. | |
| 7,243,725 | B2 * | 7/2007 | George et al. | 166/299 |
| 7,287,589 | B2 | 10/2007 | Grove et al. | |
| 7,428,921 | B2 | 9/2008 | Grove et al. | |
| 7,430,965 | B2 * | 10/2008 | Walker | 102/310 |
| 7,450,053 | B2 * | 11/2008 | Funk et al. | 342/22 |
| 7,451,819 | B2 | 11/2008 | Chang et al. | |
| 7,621,342 | B2 * | 11/2009 | Walker | 175/4.55 |
| 7,900,699 | B2 * | 3/2011 | Ramos et al. | 166/250.01 |
| 2005/0061506 | A1 | 3/2005 | Grove et al. | |
| 2005/0133220 | A1 * | 6/2005 | Bishop | 166/255.2 |
| 2005/0167108 | A1 | 8/2005 | Chang et al. | |
| 2005/0236183 | A1 | 10/2005 | Grove et al. | |
| 2006/0075889 | A1 * | 4/2006 | Walker | 89/1.15 |
| 2006/0283592 | A1 * | 12/2006 | Sierra et al. | 166/281 |
| 2007/0079960 | A1 | 4/2007 | Grove et al. | |
| 2008/0062036 | A1 * | 3/2008 | Funk et al. | 342/22 |
| 2009/0032258 | A1 | 2/2009 | Chang et al. | |
| 2009/0084552 | A1 | 4/2009 | Behrmann et al. | |
| 2009/0114382 | A1 | 5/2009 | Grove et al. | |

FOREIGN PATENT DOCUMENTS

| | | | |
|---|---|---|---|
| GB | 2406114 | A | 3/2005 |
| GB | 2406865 | A | 4/2005 |
| GB | 2408057 | A | 5/2005 |
| GB | 2413837 | A | 11/2005 |
| GB | 2421966 | A | 7/2006 |
| GB | 2426040 | A | 11/2006 |
| WO | 0165060 | A1 | 9/2001 |
| WO | 2009042479 | A1 | 4/2009 |

* cited by examiner

METHOD AND APPARATUS FOR PERFORATING WITH REDUCED DEBRIS IN WELLBORE

CROSS-REFERENCE TO RELATED APPLICATION

The present application claims priority and benefit to U.S. Provisional Application No. 61/140,937 that was filed on Dec. 27, 2008, which is incorporated by reference herein in its entirety.

TECHNICAL FIELD

The present application generally relates to perforating activities, and more specifically to reduction of debris in a wellbore.

BACKGROUND

Productivity or injectivity of a well relates to the wellbore radius. The larger the wellbore radius, the better the productivity or infectivity. However, drilling a larger borehole could be prohibitive because of substantial increase of drilling and completion cost for a larger borehole. For a weak or unconsolidated formation, it would be beneficial to enlarge the wellbore by producing sand to some extent before fracture packing and other gravel packing operations. Perforating in such weak or unconsolidated sand formations often induces collapse of the perforation tunnels and even the near wellbore formation. Hence, the perforation naturally allows sand production from the formation for enhancement of the productivity or injectivity. However, conventional perforation in weak or unconsolidated sand also results in sand accumulation in the wellbore. The produced sand in the wellbore can clog the gun and complicate the completion operations. For example, sand control and other completion devices may not be able to be positioned at the right place before the sand in the wellbore is completely cleaned out. Therefore, although producing some sand from formation through perforations may increase the well productivity and infectivity, it is beneficial not to produce any sand into the wellbore after perforation.

Except for sand production from the perforation in weak or unconsolidated formation, debris in the perforation tunnels for consolidated formation is also detrimental for well productivity and injectivity. Dynamic underbalanced perforating techniques, disclosed in U.S. Pat. No. 6,554,081, U.S. Pat. No. 6,598,682, U.S. Pat. No. 7,121,340 and U.S. Pat. No. 7,182,138, can be very efficient to remove the crushed zone near the wall of the perforation tunnels and clean the debris in the perforation tunnels out of formation. However, for weak or unconsolidated sand formation, dynamic underbalance perforating can actually sometimes make the sanding worse. Without proper control, the produced sand could lead to the failure of the completion operations.

Hence, it is desirable to have a better perforating technique in weak or unconsolidated formation.

SUMMARY

The following summary highlights features of preferred embodiments and is in no way meant to unduly limit the scope of any present or future related claims.

According to various features and embodiments of the present application, a perforating method includes lowering the perforating system into a well to the targeted formation interval, orienting the gun and all charges at a pre-selected direction or within a confined angle around the azimuth of the wellbore, using mechanical means to allow the perforation gun sufficiently contacting/closing the casing in the targeted direction, and detonating the charges and establishing communication between the inner volume of the gun carrier and the formation, and allowing formation fluids, loosening sand and other debris to flow into the gun carrier without discharging into the annulus between the gun carrier and casing. In one embodiment, the perforating system includes sealing rings that restricts the flow communication between wellbore space and the inner gun carrier. In another embodiment, flow restrictors are installed on the perimeter of the gun carrier and surround the shaped charges. In another embodiment, the perforating system includes a sliding sleeve that closes the perforated holes in the gun carrier after some times of the charges being detonated.

An embodiment includes a perforating system having a perforating gun with a tubular gun housing defining an inner volume and extending in an axial direction. A shaped charge is held in a loading tube. The loading tube is located in the gun housing. The loading tube extends along the axial direction. The shaped charge faces in a firing direction substantially perpendicular to the axial direction. A portion of the gun housing adjacent to the shaped charge in the firing direction is a perforating portion for removal upon firing of the shaped charge. An eccentralizer member extends from the perforating gun in a second direction that is substantially opposite and parallel with the firing direction. A first retainer part extends from an outer surface of the gun housing adjacent to the perforating portion. A second retainer part extends from the outside of the gun housing adjacent to the perforating portion. The inner volume of the gun housing is insulated from pressure outside of the gun housing until firing of the shaped charge perforates the perforating area.

This and other features and embodiments are discussed herein.

BRIEF DESCRIPTION OF THE DRAWINGS

The following is a brief description of the figures herein which illustrate various features of embodiments.

The preceding brief description of figures is meant to help understand the features of embodiments discussed in the present application and is in no way meant to be used to limit any claims in this application or any subsequent related claims.

DETAILED DESCRIPTION

In the following description, numerous details are set forth to provide an understanding of features and embodiments of the present application. However, it will be understood by those skilled in the art that features and embodiments within the present application may be practiced without many of these details and that numerous variations or modifications from the described embodiments are possible. These details are not meant in any way to be used to unduly limit claims in this application or any future related claims.

As used here, the terms "above" and "below"; "up" and "down"; "tipper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

Figure 1:
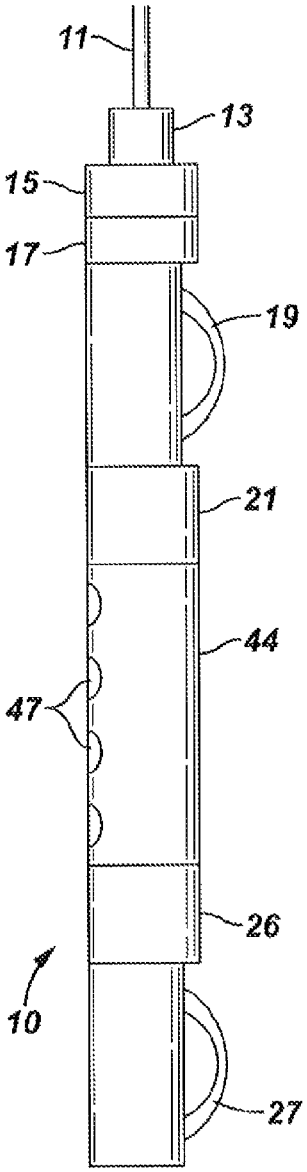
FIG. 1 is a schematic of features of a perforating system according to an embodiment.

FIG. 1 shows an embodiment of a perforating gun system 10. The perforating gun system 10 includes a wireline cable 11 connected to a cable head 13. It should be noted that other conveyance devices can be used in place of wireline, e.g., coiled tubing, piping, slickline, etc. The gun system 10 also includes a casing collar locator (CCL) 15 and a gyroscope module 17. Both such devices are available commercially, e.g. from Schlumberger (CCL tool and/or Wireline Oriented Perforating Tool). The CCL 15 measures the location of the perforating system 10 along a borehole while the gyroscope 17 provides the azimuthal measurement of the system 10, e.g., with respect to the magnetic north. An upper eccentralizer 19 can include bowed springs and can be connected beneath the gyroscope 17. A firing head 21 is located below the eccentralizer 19. A gun carrier 44 is connected to the firing head 21. The lower eccentralizer 27 is below the gun carrier 44. The upper and lower eccentralizer 19 and 27 have the same setting direction. Charges 47 in the gun carrier 44 are preferably loaded in a 180° phasing angle opposite to the setting direction of the eccentralizers 19 and 27, but given various circumstances, can be slightly deviated from a 180° phase. Device 26 is an empty volume adapted to hold produced sand and debris. The device 26 can be the bottom part of the gun carrier 44 if all charges are loaded at the upper portion of the gun carrier 44. Alternatively, a properly sized chamber can be used for the chamber 26. The chamber 26 is attached beneath the gun carrier 44 to hold the produced sand and debris and is internally communicated to the gun carrier 44. Although this embodiment is valid for the device 26 being either the bottom portion of the gun carrier 44 or an individual chamber, a chamber 26 is assumed to hold the sand and debris in the following description.

A first step of a perforating method according to embodiments in the present application includes running the perforating system 10 into the wellbore. Based on the CCL measurements, the perforating system 10 is set at the formation interval to be perforated.

Figure 2:
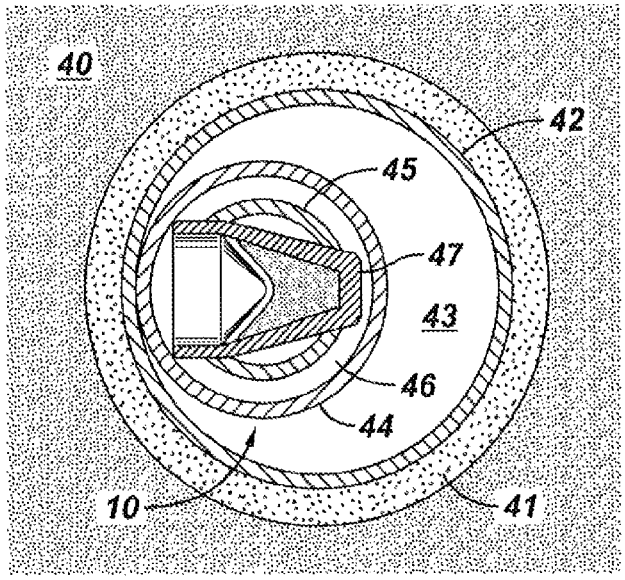
FIG. 2 shows a top sectioned view of features of the system of FIG. 1 according to an embodiment.

A second step is to orient the perforating system 10 at the pre-defined azimuthal direction based on the measurements from the gyroscope 17. Once the pre-defined azimuthal direction is achieved, the eccentralizers 19 and 27 are set to push the charge shooting portion of the gun carrier 44 against the casing wall. The cross-section view of the perforating system 10 is shown in FIG. 2. The perforating system 10 is positioned inside the casing 42 with the shooting side (perforating portion) of the gun carrier 44 adjacent to, and preferably, contacting the casing wall 42 after the bowed springs of the eccentralizers 19 and 27 are properly set in 180° phasing from the charge firing direction.

A third step is to control the pressure differentials among the major regions before the charge detonation. Referring to FIG. 2, the entire working space can be distinguished into three major regions. The first region is the formation sand 40, which is isolated from the wellbore space 43, which is the second region, by the cement sheath 41 and the casing 42. The formation sand region 40 contains formation fluid. The fluid pressure in the formation sand region 40 is denoted by $P_{pore}$. The wellbore space 43 can contain completion fluid. The wellbore fluid pressure at the location of the gun carrier 44 is $P_{well}$. The third region is the inner gun space 46, which is isolated from the wellbore 43 by the gun carrier 44. The inner gun space 46 is filled with air or other low pressure gases. Shaped charges 47 and loading tube 45 are inside the gun carrier 44, so they are preferably completely isolated from the wellbore space 43 and formation sand region 40 before the cement sheath 41, casing 42 and the gun carrier shell 44 are perforated by the shaped charges 47. The loading tube 45 could be other designs other than a tube so long as the charges 47 are held properly. The loading tube 45 preferably is not completely pressure insulated so that the fluid pressure inside the gun carrier 44 and inside the loading tube 45 has the same pressure $P_{gun}$ before the perforation. The current embodiment adjusts $P_{well}$ and $P_{gun}$ to setup the suitable pressure differentials among the three regions. Through properly designing the gun carrier 44, loading tubing 45, charges 47, e.g. number of charges per foot of perforation, the $P_{gun}$ is maintained below the $P_{pore}$ and $P_{well}$, i.e., achieving dynamic underbalance after a short time after the charge detonation. These ideas are discussed in U.S. Pat. No. 6,554,081, U.S. Pat. No. 6,598,682, U.S. Pat. No. 7,121,340 and U.S. Pat. No. 7,182,138, which are incorporated herein by reference in their entirety. Although not absolutely necessary, it is preferable that $P_{well}$ be close to or somewhat less than $P_{pore}$ before the first perforating run. An appropriate $P_{well}$ value can be set by using a particular density and height of the completion fluid in the wellbore 43. If the communication between the wellbore space 43 and the formation 40 is established after the first run and the formation 40 has a single hydrostatic pressure gradient system, the $P_{well}$ can be equal or very close to $P_{pore}$ in the subsequent runs.

Figure 3:
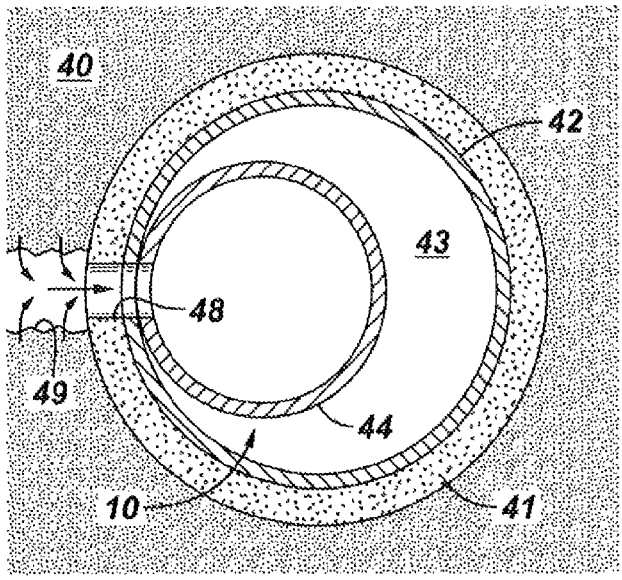
FIG. 3 shows a top sectioned view of features of the system of FIG. 1 after firing according to an embodiment.

A fourth step is to detonate the charges in the perforating system 10. The perforated cement sheath 41, casing 42 and gun carrier shell 44 establish communications between the formation fluid 40 and the inner gun volume 46. $P_{gun}$ is substantially lower than $P_{pore}$ and $P_{well}$ after a very short period of time after the charge detonation (e.g., about several to tens of milliseconds). This results in the dynamic underbalance phenomenon which can lead to collapse of some perforation tunnels for weak or unconsolidated formation and the formation fluid 40 and wellbore fluid 43 filling in the inner gun volume 46. Because the shooting portion of the gun carrier 44 is set against the casing wall 42 at the perforated holes 48 and 49 as shown in FIG. 3, the communication between formation 40 and the inner gun volume 46 is maximized while the communication between the wellbore space 43 and the inner gun volume 46 is substantially restricted. This directs surge fluid flow from the formation 40 to the inner gun volume 46. The directed surge flow enables the loose sand and debris in the perforation tunnel 49 to move into the inner gun volume 46 while reducing/minimizing sand and debris production in the wellbore space 43.

After sufficient time, the produced sand and debris settle down to the sand and debris holder 26. The eccentralizers 19 and 27 are unset and the perforating system 10 is retrieved from the wellbore. Enlarging wellbore radius behind casing by producing some formation sand without the sand accumulation in wellbore is achieved at the same time using the present embodiment.

The perforating system 10 can be reloaded and rerun numerous times as needed to perforate the well in the same or other azimuthal directions. In each of these runs, sand and debris accumulation in the wellbore will be reduced/minimized. Therefore, the goal of reduced, preferably no, debris perforating can be better realized while productivity of the well is enhanced by removing some sands near the perforating tunnels.

The eccentralizers 19 and 27 with bowed springs used in the perforating system 10 are only one example of various devices applicable in this application. Other devices may be installed in the perforating system 10 with similar functionality, e.g., springs, magnets, telescoping devices or arms. Also, more than one eccentralizer spaced radially can be used so long as they are evenly spaced from 180° of the firing direction of the shaped charge 47, e.g. one on each side.

Figure 4A:
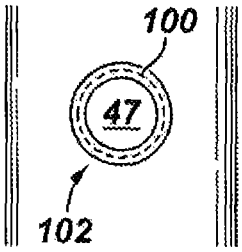
FIG. 4A shows a front view of features including a sealing ring according to an embodiment.
Figure 4B:
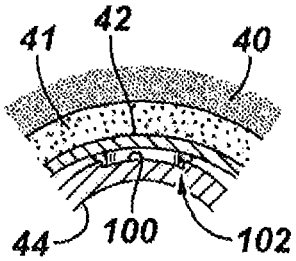
FIG. 4B shows a top section view of features including the sealing ring and a portion of a perforating system according to an embodiment.
Figure 4C:
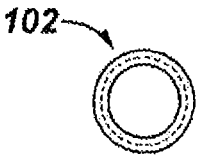
FIG. 4C shows a sealing ring according to an embodiment.
Figure 4D:
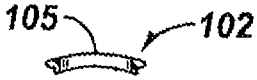
FIG. 4D shows a top view of a sealing ring and portions of the perforating system according to an embodiment.

To further restrict the flow communication between the wellbore space 43 and the inner gun volume 46, retainer parts can be applied to an outside surface of the gun carrier 44 in proximity to the perforating portion of the gun carrier 44. For example, sealing rings 102 can be used on scallops 100 on the gun carrier 44. FIG. 4B shows the sealing ring 102 and its application in reducing the fluid flow from the wellbore space 43 to the inner gun volume 46. FIG. 4A shows the sealing ring 102 installed on a scallop 100 of the gun carrier 44. FIG. 4B is the side view of the sealing ring 102 installed on a scallop 100 in the gun shell 44. FIG. 4C shows the front view of the sealing ring 102 while FIG. 4D is its side view. The curvature of the sealing ring 102 used in the perforating system 10 is determined by the curvature of the casing inside diameter 42 for the job. The outer edge 105 of the sealing ring 102 has a curvature substantially close to that of the casing inside diameter 42. This minimizes flow communication between the wellbore space 43 and the inner gun space 46 while maximizing the flow communication between the formation 40 and the inner gun volume 46. Preferably, the sealing rings 102 are made with conventional elastomer in this application but other materials can also be used. For example, the sealing rings could be made from high temperature polymers. Also, the sealing rings 102 can be made from metal, e.g. steel. The sealing rings 102 can be installed on the gun carrier 44 through the spiral grooves on the sealing rings 102 and the scallops 100. The sealing rings 102 can also be attached with adhesives, by fasteners, by clamps, or by welding. Alternatively, the sealing rings 102 can be an extension of the material making up the gun carrier 44. Note that the inner diameter of the sealing rings 102 should be larger than that of the perforating portion of the gun carrier 44, i.e., perforated holes on the gun carrier 44, in that the sealing rings 100 would not be damaged by the perforators during perforation.

Figure 5:
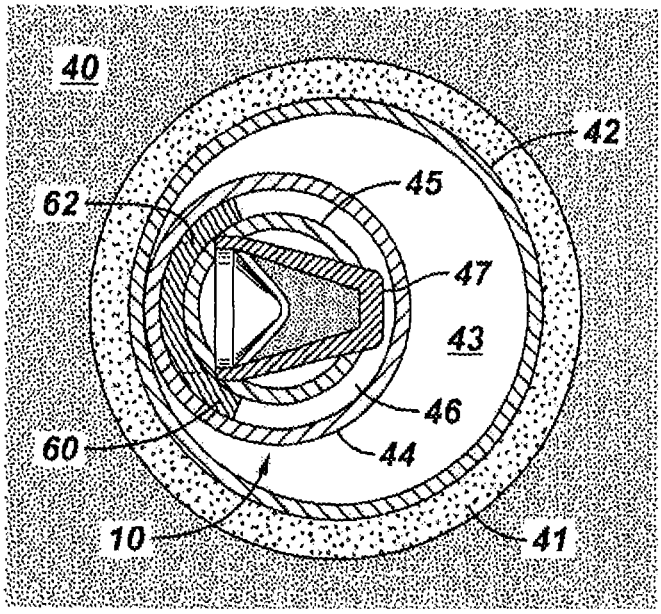
FIG. 5 shows a top cut away view of a perforating system with a sleeve according to an embodiment.

Another method to reduce the debris and sand production in the wellbore is to close the perforated holes on the gun carrier 44 after the gun volume 46 contains debris, e.g. is filled up. FIG. 5 shows a sliding sleeve 60 for this purpose. The sliding sleeve 60 has a pre-manufactured hole 62 coaxially aligned with the shaped charge. The diameter of the hole 62 is larger than that of the perforated hole on the gun carrier 44 so that the jet of a detonated charge 47 would not be spent in penetrating the sleeve 60. Therefore, the penetration of the shaped charge 47 would not be reduced by the existence of the sleeve 60. Note that the sleeve 60 can close either all perforated holes or a portion of the holes in gun carrier 44. For closing a portion of the holes, it is preferable to close those at the lower part of the gun carrier 44. Also note that the sleeve 60 can close the perforated holes through longitudinal movement along the axis of the gun carrier 44. Alternatively, it can close them through rotating along the azimuth of the gun carrier 44, or the combination of the longitudinal and azimuthal movements. Closing the perforated holes in the gun carrier 44 is particularly beneficial for perforating a horizontal or large deviated well. The holes on the gun carrier 44 can be closed either just after the charges are detonated or at the termination of the dynamic under-balance response or after the complete settlement of the produced sands inside the gun carrier 44. The exact timing of perforated-hole closure by the sleeve 60 depends on operational considerations in each individual dynamic under-balance operation. The closure can be performed automatically by setting time delay after the detonation of the charges or controlled by operators on the surface.

Figure 6:
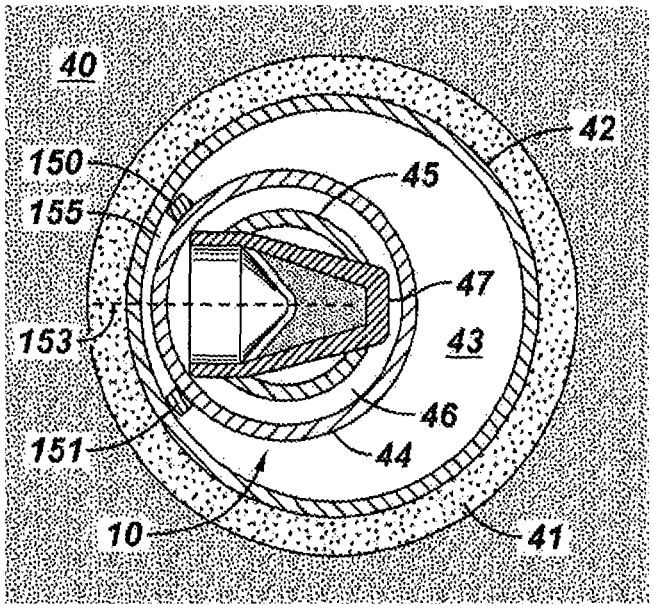
FIG. 6 shows a top cut away view of a perforating system with vertical flow restrictors.

In another embodiment, flow restrictors are used to reduce the flow communication between the inner gun volume 46 and the wellbore 43. FIG. 6 shows an application of the flow restrictors 150 and 151 on the gun 23. The flow restrictors 150 and 151 can be made by various materials with a variety of geometries. The flow restrictors 150 and 151 can be installed in any locations that straddle (preferably symmetrically) the zero phasing line 153 of the perforating. The two flow restrictors 150 and 151 should contact the casing 42 and allow a small gap 155 between the gun shell 44 and the inside diameter (ID) of casing 42. This gap enables the flow communication between the formation 40 and the gun inner space 46 when the perforated tunnels on the casing and holes on gun carrier 44 do not line up if there is a gun movement after perforating. The devices 150 and 151 substantially reduce the fluid flow moving from outside of the two restrictors into the gap 155 within the two restrictors. This maximizes the fluid flow from the formation 40 to the inner gun space 46 so that the produced solid debris and sands are drawn into the inner gun volume 46. Another benefit of using the flow restrictors 150 and 151 is that the perforating does not have to be zero phasing. A range of azimuthal angles of perforating phasing is possible depending on the position and height of the flow restrictors 150 and 151 installed on the gun carrier 44.

Figure 7:
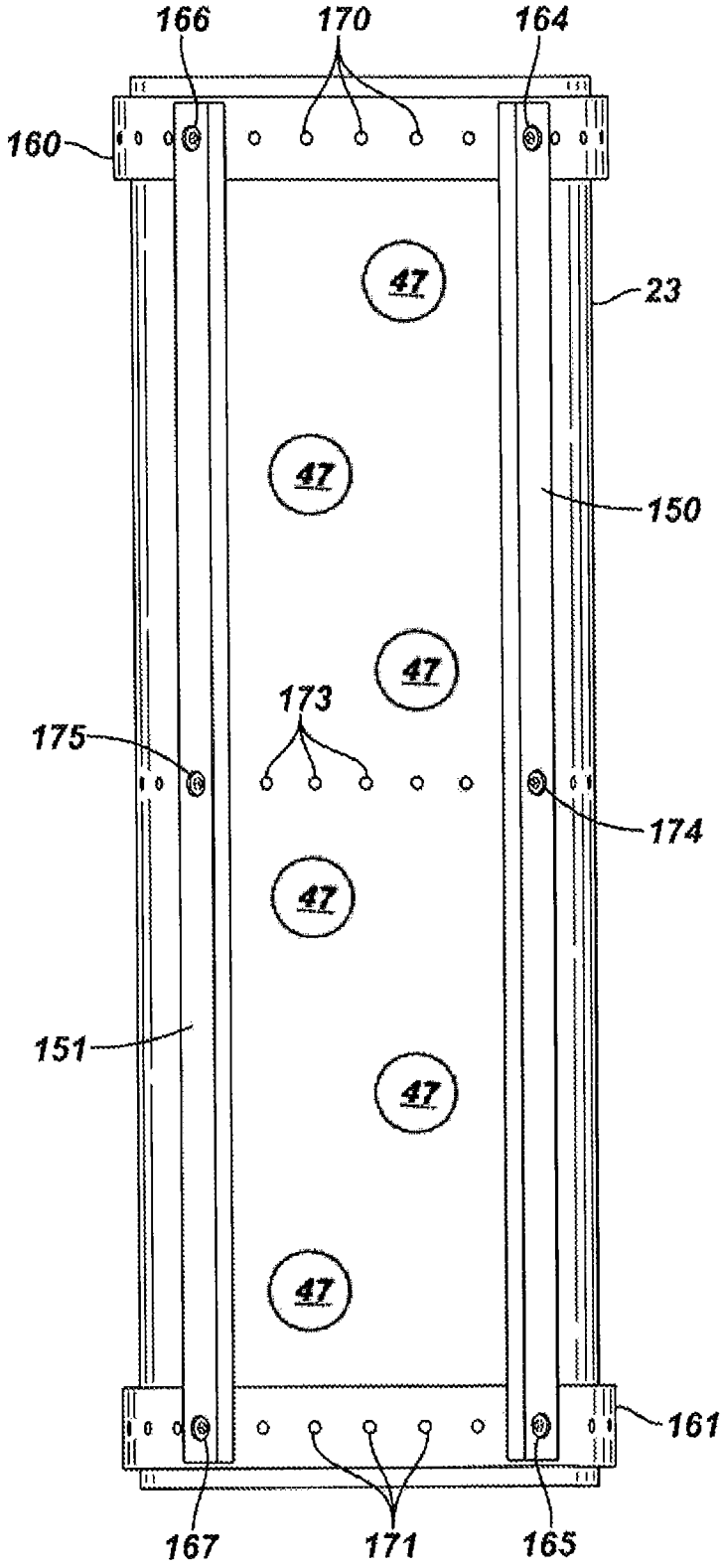
FIG. 7 shows a front view of a perforating system with horizontal flow restrictors.

FIG. 7 is the front view of the flow restrictors 150 and 151 that are assembled on the perimeter of the gun carrier 44. The two clamps 160 and 161 are connected to the two ends of the gun 23. A number of holes 170 and 171 with spiral grooves are distributed in the clamps 160 and 161. The flow restrictor 150 is attached to the gun carrier 44 by the two screws 164 and 165 into the threaded holes 170 and 171 on the clamps 160 and 161, respectively. The flow restrictor 151 is attached to the gun carrier 44 through the two screws 166 and 167 on the clamps 160 and 161, respectively. In another embodiment, the holes 170 and 171 with the spiral grooves are manufactured near the end of the gun carrier 44 rather than on the clamps 160 and 161. To secure the flow restrictors 150 and 151 on the gun carrier 44, there may be one or more groups of the threaded holes 173 in the middle of the gun carrier 44. The screws 174 and 175 further secure the flow restrictors 150 and 151, respectively, on the gun carrier 44. Other types of assembly are also possible to install the flow restrictors 150 and 151 on the gun carrier 44. For example, the flow restrictors 150 and 151 can be welded on the gun carrier 44.

Figure 8:
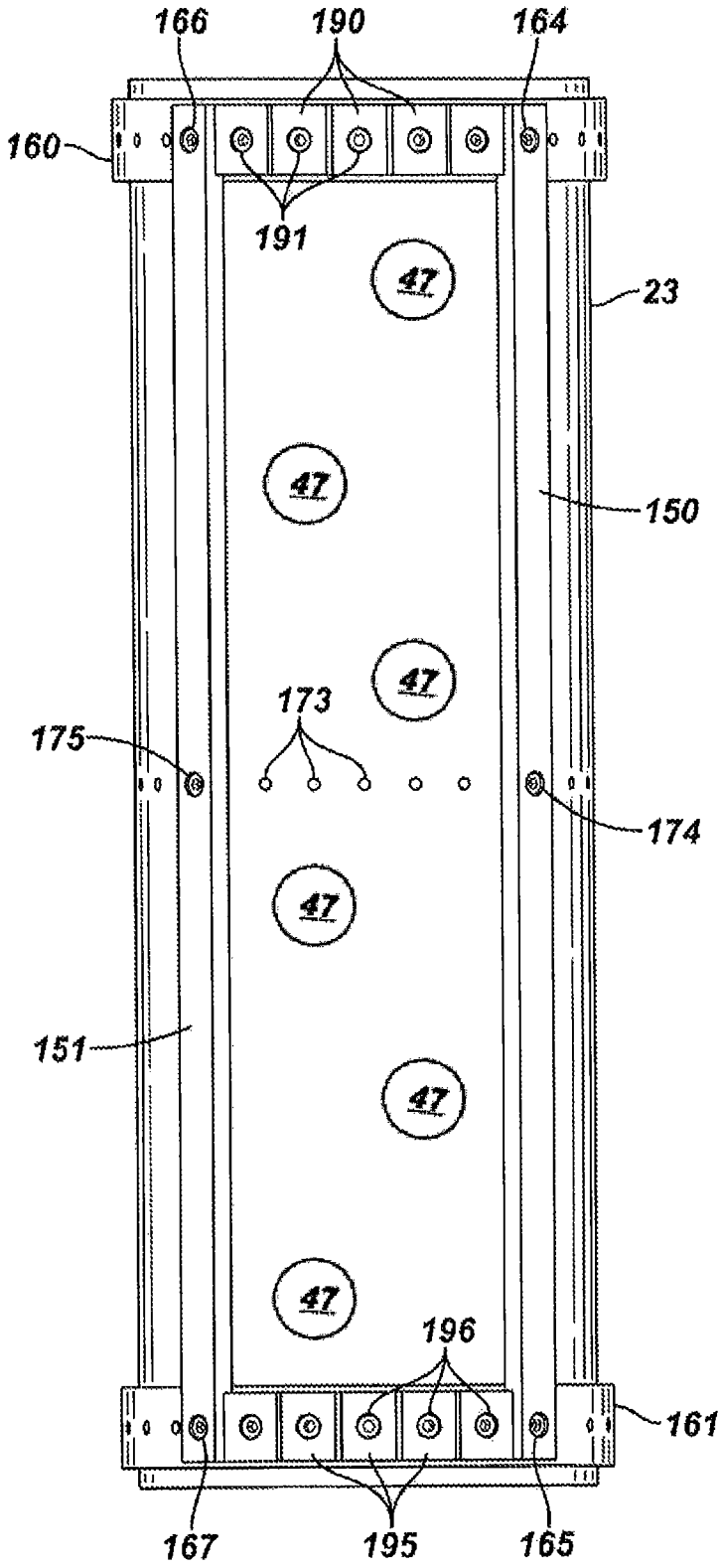
FIG. 8 shows a front view of a perforating system with vertical flow restrictors and horizontal flow restrictors.

In addition to the flow restrictors 150 and 151 that reduce the lateral fluid flow from the wellbore 43 into the gap 155 between the two restrictors, the vertical fluid flow from the wellbore 43 above and below the gun carrier 44 into the gap region 155 should also be confined. FIG. 8 shows the vertical flow restrictors 190 installed between the two horizontal flow restrictors 150 and 151 on the upper end of the gun carrier 44. The outer curvature of the restrictor 190 has substantially similar to that of the casing ID 42, while its inner curvature is substantially similar to that of the gun OD. Screws 191 can be used to connected the vertical flow restrictor 190 to the gun carrier 44. The same installation of the vertical flow restrictor can be applied on the bottom end of the gun. The vertical flow restrictor 190 can also be installed at the bottom of the gun carrier 44.

In another embodiment, multiple flow restrictors can be used to replace the single vertical flow restrictor 190. As shown in FIG. 8, the multiple vertical flow restrictors 195 are installed on the bottom end of the gun carrier 44. Each piece of the multiple vertical flow restrictors 195 is connected to the gun carrier 44 through a screw 196 and the holes with spiral groove on the gun. The inner and outer curvatures of the multiple vertical flow restrictors 195 are substantially similar to those of the gun carrier 44 and the casing ID 42, respectively. The multiple vertical flow restrictors 195 can also be installed on the top of the gun carrier 44.

The vertical flow restrictors 190 and 195 may be installed without the horizontal flow restrictors 150 and 151, and vice versa. There is also no restriction that the vertical flow restrictors are installed within the horizontal flow restrictors 150 and 151. The vertical flow restrictor 190 or 195 can be installed on the entire periphery of the gun carrier 44, or just a portion thereof.

In addition to the wireline, the perforating system 10 can also be conveyed to the targeted location in a well by other methods. For example, the perforating system 10 can be installed in drill pipes, tubing pipes, coiled tubing or other convey means to realize the same perforating results with low debris in the wellbore. All the embodiments herein are applicable regardless of the conveyance differences.

The preceding description is mean to illustrate various features described in the present application and is not meant to limit the present or future related claim scope in any way.

What is claimed is:

1. A perforating system, comprising:

a perforating gun for being positioned within a well bore;

a tubular gun housing of the perforating gun extending in an axial direction;

an exterior surface of the tubular gun housing;

an inner volume of the gun housing sealed by the exterior surface of the gun housing having an inner volume pressure thereof and configured to receive fluid and debris therein;

a perforating portion of the gun housing configured to be perforated to provide fluid access to the inner volume;

a plurality of shaped charges located in the inner volume of the tubular gun housing adjacent the perforating portion and extending along the axial direction configured to perforate the perforating portion of the gun housing and a wellbore wall to provide fluid communication between the inner volume of the gun housing and the formation located beyond the perforated wellbore wall;

a firing direction of the plurality of shaped charges substantially perpendicular to the axial direction and towards the perforating portion of the gun housing;

an eccentralizer member extending from the external surface of the tubular gun housing of the perforating gun in a second direction that is substantially opposite to the firing direction;

a first flow restrictor connected to the exterior surface of the gun housing and extending in the axial direction adjacent to the perforating portion;

a second flow restrictor connected to the exterior surface of the gun housing and extending in the axial direction adjacent to the perforating portion opposite from the first flow restrictor;

a third flow restrictor extending circumferentially along the exterior surface of the gun housing above the plurality of the shaped charges; and a fourth flow restrictor extending circumferentially along the exterior surface of the gun housing below the plurality of shaped charges; and wherein the first and second flow restrictors are configured to extend from the exterior surface of the gun housing to engage an inner wall of a wellbore and further restrict fluid flow from within the wellbore through the perforated portion of the gun housing after the shaped charges have been detonated.

2. The perforating system of claim 1, comprising a gyroscope device connected with the perforating gun to angle the perforating gun at a predetermined angle.

3. The perforating system of claim 1, further comprising a well casing in contact with the first flow restrictor and the second flow restrictor.

4. The perforating system of claim 1, further comprising a collector defining a collection volume connected with the inner volume of the gun housing located below the perforating portion configured to receive debris and fluid therein.

5. The perforating system of claim 1, comprising a casing collar locator that measures downhole location of the perforating gun.

6. The perforating system of claim 1, wherein the eccentralizer is a bowed spring.

7. A method of perforating, comprising:

deploying a perforating gun downhole in a well, the well having a well casing, the perforating gun comprising:

a gun housing defining an inner volume, the gun housing extending in an axial direction;

an exterior surface of the gun housing;

an inner volume of the gun housing provided by the exterior surface of the gun housing and having a inner volume pressure and configured to receive fluid and debris therein;

a plurality of shaped charges located in the gun housing and extending along the axial direction;

a perforating portion of the gun housing adjacent to the plurality of shaped charges;

a firing direction of the shaped charges extending perpendicular to the axial direction and towards the perforating portion of the gun housing;

an eccentralizer member extending from the exterior surface of the perforating gun in a second direction that is opposite the firing direction;

a first flow restrictor connected to the exterior surface of the gun housing and extending-in the axial direction adjacent a first side of the perforating portion; and a second flow restrictor connected to the exterior surface of the gun housing and extending in the axial direction adjacent a second side of the perforating portion opposite from the first side of the perforating portion;

a third flow restrictor extending circumferentially along the exterior surface of the gun housing above the plurality of the shaped charges; and a fourth flow restrictor extending circumferentially along the exterior surface of the gun housing below the plurality of shaped charges;

locating the-first and the second flow restrictor against the well casing by applying force on the well casing with the eccentralizer member so that the perforating portion of the gun housing faces the well casing;

firing the plurality of shaped charges thereby perforating the perforating portion of the gun housing and perforating the well casing thereby creating a fluid connection path between the inner volume of the gun housing and the formation located outside the well casing having a formation pressure greater than the inner volume pressure of the gun housing; and drawing wellbore debris and fluids into the inner volume of the gun housing via the fluid connection path until the formation pressure and inner volume pressure equalize, the first flow restrictor and second flow restrictor configured to restrict fluid flow from within the wellbore from entering the inner volume of the gun housing through the perforated, portion thereof; and maintaining the debris in the inner volume of the gun housing.

8. The method of claim 7, wherein the perforating gun further comprises a collector defining a collection volume connected with the inner volume of the gun housing located below the perforating portion configured to receive debris and fluid therein.

9. The method of claim 7, wherein the perforating gun further comprises:

a collector defining a collection volume connected with the inner volume of the gun housing located below the perforating portion configured to receive debris and fluid therein;

an upper flow restrictor extending circumferentially along the exterior surface of the gun housing above the plurality of the shaped charges; and a lower flow restrictor extending circumferentially along the exterior surface of the gun housing below the plurality of shaped charges.

10. The method of claim 7, wherein the perforating gun further comprises a casing collar locator that measures downhole location of the perforating gun.

11. The method of claim 7, wherein the eccentralizer is a bowed spring.

12. The method of claim 7, wherein the perforating gun further comprises a gyroscope device connected with the perforating gun to angle the perforating gun at a predetermined angle.

* * * * *